US007445505B1

(12) United States Patent
Yi

(10) Patent No.: US 7,445,505 B1
(45) Date of Patent: Nov. 4, 2008

(54) ELECTRICAL CONNECTOR WITH ESD PROTECTION

(75) Inventor: Chong Yi, Mechanicsburg, PA (US)

(73) Assignee: Hon Hai Precision Ind. Co., Ltd., Tapei Hsien (TW)

( * ) Notice: Subject to any disclaimer, the term of this patent is extended or adjusted under 35 U.S.C. 154(b) by 0 days.

(21) Appl. No.: 11/980,111

(22) Filed: Oct. 30, 2007

(51) Int. Cl.
*H01R 13/648* (2006.01)

(52) U.S. Cl. ..... 439/607; 439/181

(58) Field of Classification Search ..... 439/607, 439/608, 88, 181, 186, 187, 921
See application file for complete search history.

(56) References Cited

U.S. PATENT DOCUMENTS 5,947,773 A 9/1999 Karam
6,315,609 B1 11/2001 Chung
6,942,503 B2 * 9/2005 Yamaguchi et al. ..... 439/141
7,059,879 B2 * 6/2006 Krause et al. ..... 439/181

* cited by examiner

*Primary Examiner*—Khiem Nguyen
(74) *Attorney, Agent, or Firm*—Wei Te Chung

(57) ABSTRACT

An electrical connector (100) for receiving a mating plug (200) having a number of plug contacts and a metal shell. The electrical connector has an insulative housing (10) provided with a base portion (13) and a tongue portion (14, 15) extending forwardly from the base portion. A set of first electrical contacts (21) and a set of second electrical contacts (22) are arranged in the isulative housing for engaging with the plug at a front and a rear position respectively. Each contact (21, 22) includes a contact section (214, 222) electrical connected with the contacts of the plug. An insulator (40) is located in front of the first electrical contacts for avoiding an improper connection between the contacts and the plug.

17 Claims, 16 Drawing Sheets

ELECTRICAL CONNECTOR WITH ESD PROTECTION

BACKGROUND OF THE INVENTION

1. Field of the Invention

The present invention relates generally to electrical connector, and more particularly to a connector having improved electrical contacts.

2. Description of Related Art

Electrical connectors are typically used to couple PCB (Printed Circuit Board) which have numerous electrical devices. Some electrical connectors have a mating end wherein conductive terminals are exposed for engagement with the terminals of a mating connector. When mating the connectors, opposite charges at the connector interface may result in an ESD between the two connectors. In fact, electrostatic discharges can be generated simply by a person approaching or touching the connector interface or touching the terminal contacts. As known, when the ambient relative humidity drops to fifty percent or below, the human body accumulates a large electrical charge which can be in excess of 20,000 volts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. But sometimes, the electrostatic discharge also happens to the signal contacts. Please refer to FIG. 16, which discloses an electrical connector 300 having J-shaped contacts 60 and a portion 61 thereof is exposed at the front area of the connector 300. A mating plug 200 includes a plurality of plug contacts 70 for mating with the contacts 60 of the electrical connector 300 and a shell 80 shielding the electrical contacts. At the front area of the electrical connector 300, there is a potential for the high speed contacts 60 to short with the shell 80 of the mating plug 200 which could also result in ESD problem.

Hence, it is desired to provide an electrical connector to overcome the problems mentioned above.

BRIEF SUMMARY OF THE INVENTION

Accordingly, an object of the present invention is to provide an electrical connector having improved electrical contacts for ESD protection.

The present invention is directed to an electrical connector for receiving a mating plug which has a plurality of plug contacts and a metal shell. The electrical connector comprises an insulative housing provided with a base portion and a tongue portion extending forwardly from the base portion. A set of first electrical contacts and a set of second electrical contacts are arranged in the insulative housing for engaging with the plug at a front and a rear position respectively. Each contact comprises a contact section electrical connected with the contact of the plug. An insulator is located in front of the first electrical contacts to prevent the first electrical contacts contacting with the shell of the plug.

The insulator could be integrally formed on the tongue portion provided with a plurality of posts for preventing the further insertion of the plug. The insulator also could be a separated element attached to the tongue portion. The insulator could cover the mating face of the electrical connector to avoid an improper connection between the first contacts and the plug.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
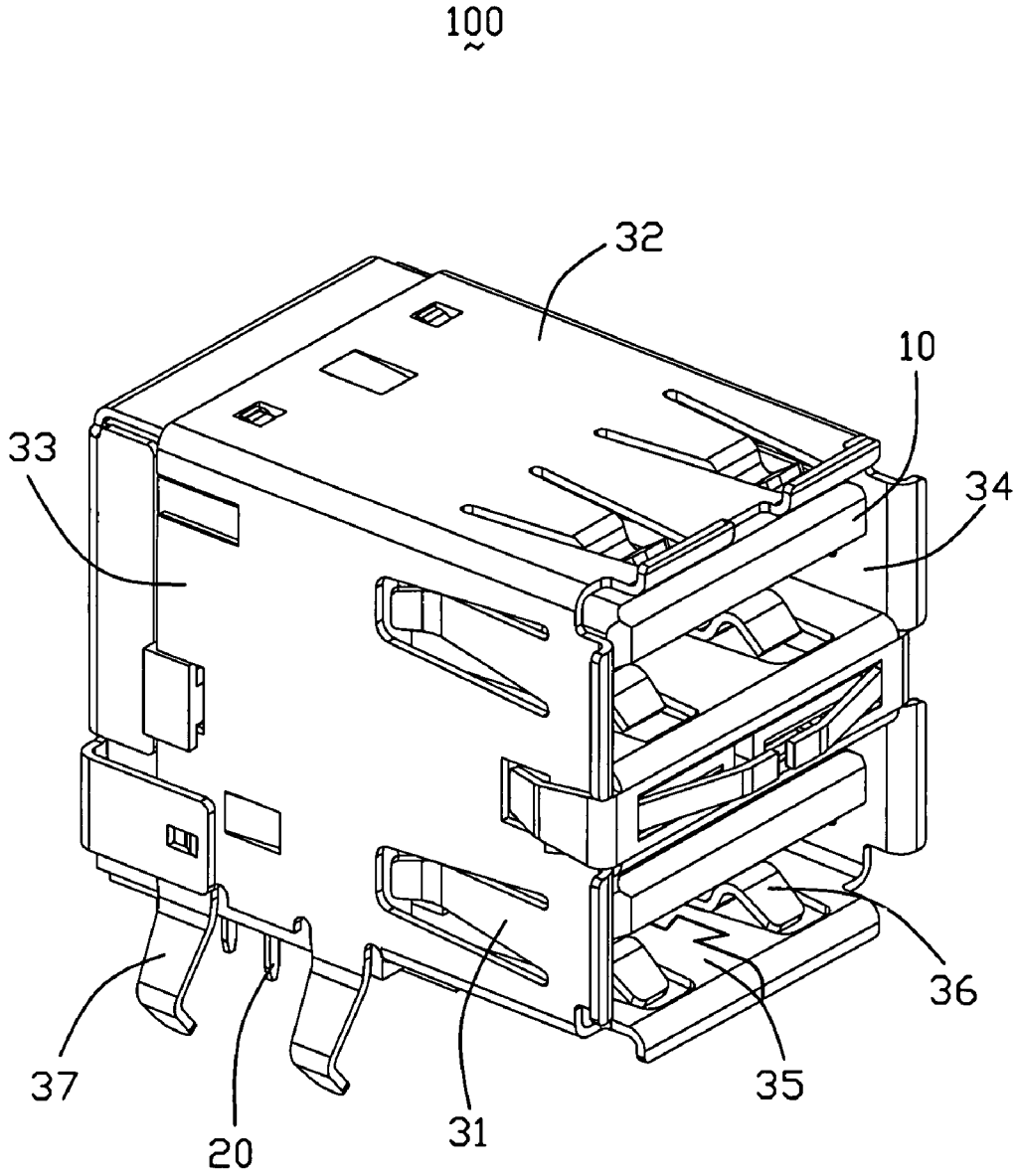
FIG. 1 is a perspective view of an electrical connector according to a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 16:
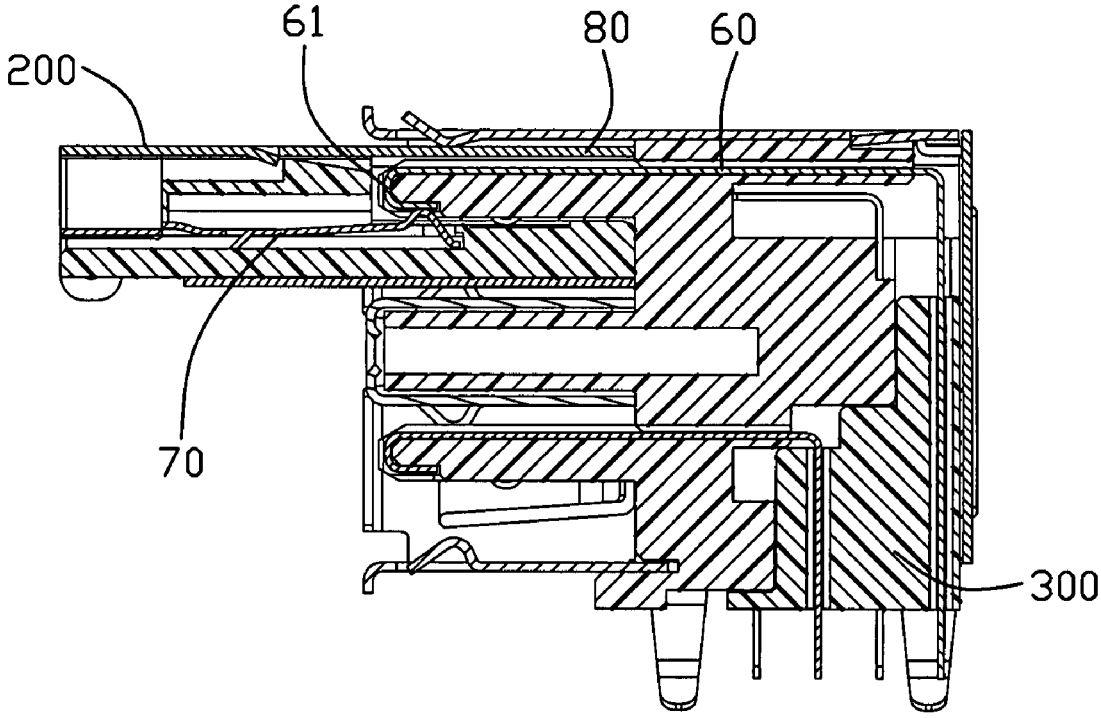
FIG. 16 is a cross sectional view of a related art with a mating plug inserted therein.

Referring to FIG. 1, the present invention is directed to an electrical connector 100 mounting to a PCB or motherboard (not shown) having an insulative housing 10 including a plurality of receiving spaces or receptacle openings 11, 12 each adapted to receive a complementary electrical plug 200 as shown in FIG. 16. The connector 100 includes a plurality of electrical contacts 20 arranged in a first and second groups corresponding to a respective one of the receptacle openings 11, 12. The connector 100 has an outer shield 30 that generally surrounds the housing 10 and has grounding contacts 31 to create an electrical connection between the conductive outer shell 80 and the plug 200 when inserted therein.

While the drawings display a dual stacked connector system 100, the present invention could be used with any type of electrical connector. While each receptacle is shown with nine contacts 20 in a group, the invention can be employed with any desired number of contacts 20 in a group. Similarly, while two receptacles 11, 12 are shown, the invention can be employed with a single receptacle or any desired number of stacked receptacles.

Figure 3:
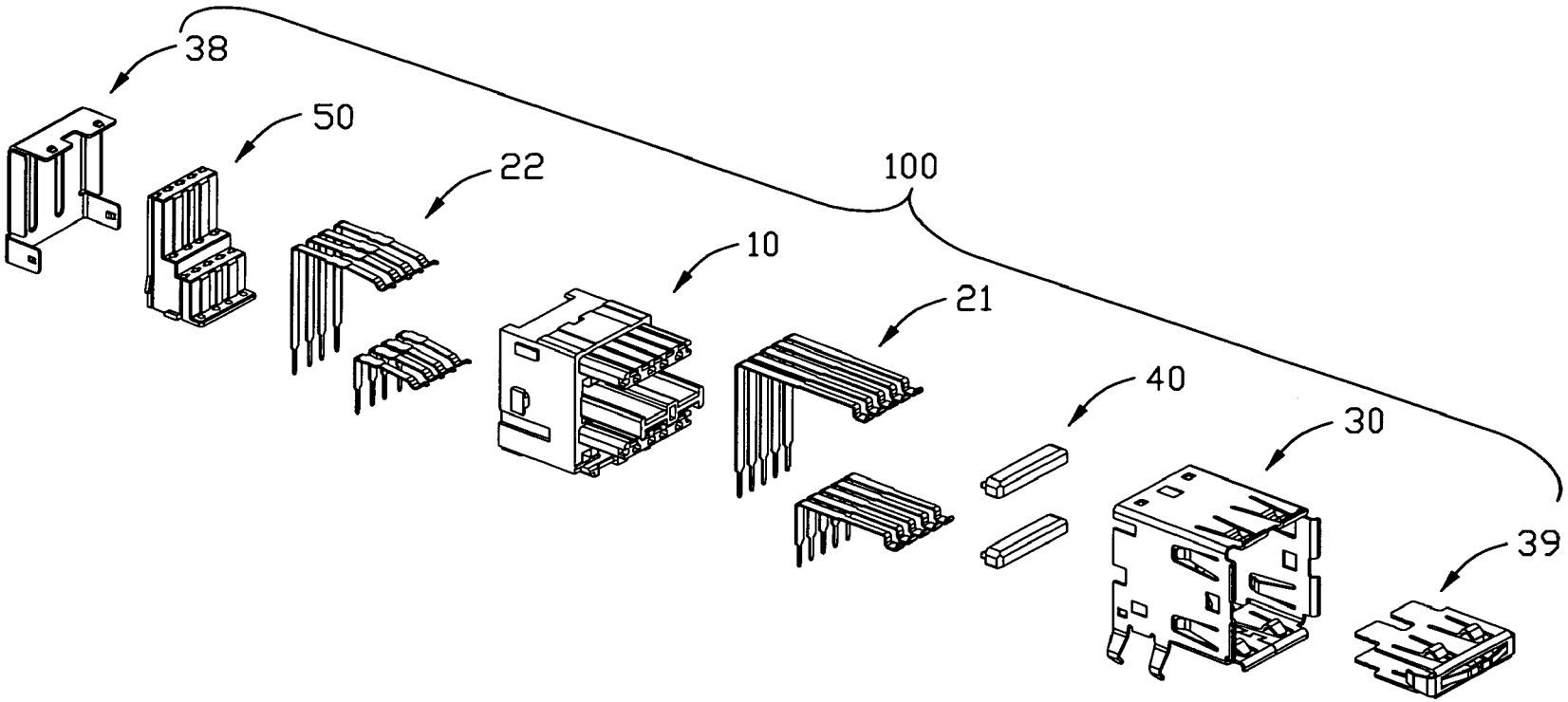
FIG. 3 is an exploded view of the electrical connector shown in FIG. 1.
Figure 4:
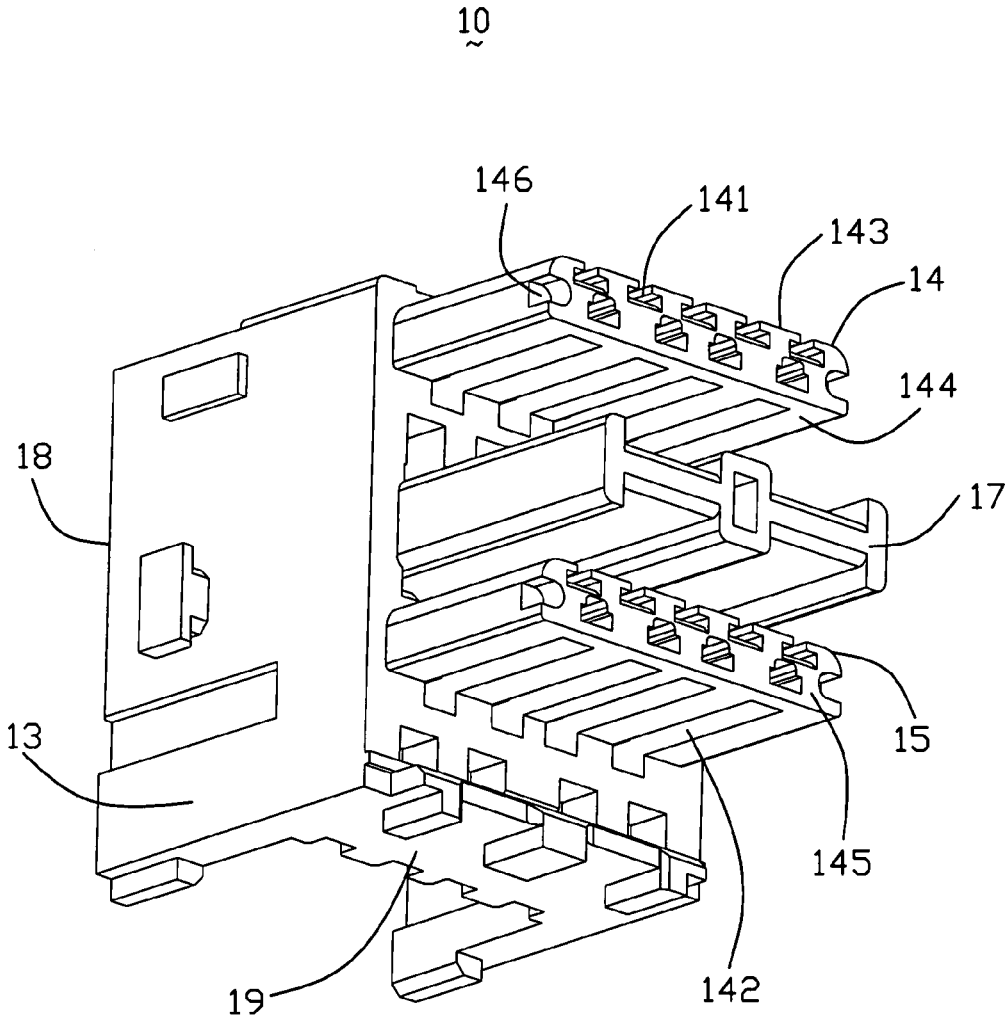
FIG. 4 is a perspective view of the insulative housing shown in FIG. 3.
Figure 5:
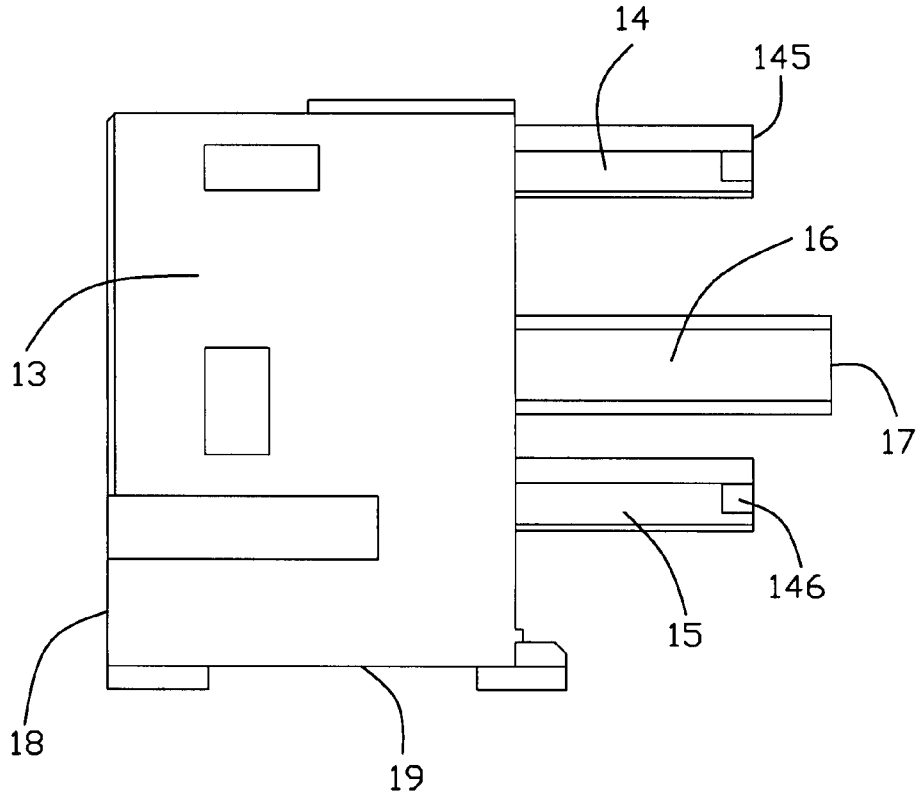
FIG. 5 is a side view of the insulative housing shown in FIG. 3.

Referring to FIGS. 1 and 3, the shield 30 is preferably stamped from a single sheet of suitable conductive material, which includes a top wall 32, opposed lateral walls 33, 34, and a bottom wall 35. The opposed top and bottom walls 32, 35 each have longitudinal springs 36 extending into the receptacles 11, 12 to bear against the corresponding shell 80 of the plug 200. Board locks 37 mate with the PCB and aid in positioning the electrical connector 100 with respect to the PCB. The shield 30 further comprises a separated rear wall 38 and a separate front wall 39 attached thereon for further shielding the electrical contacts 20 at front and rear face 17, 18 of the insulative housing 10.

As illustrated in FIGS. 2 to 5, the insulative housing 10 has a base portion 13 with tongues 14, 15 extending forwardly from the base portion 13 and carrying the electrical contacts 20. The contacts 20 may be signal contacts, power contacts, or ground contact in various combinations as desired in accordance with a particular application. Each tongue 14, 15 define two rows of recesses 141, 142 at upper and lower sides 143, 144 thereof. Upper recesses 141 are extending to a front face 145 of the tongue 14, 15. Pair of receiving holes 146 is defined on left and right sides of the tongue 14, 15. Also as illustrated, a middle flange 16 extends from the insulative housing 10 to separate receptacle openings 11, 12. The middle flange 16 is longer than the tongues 14, 15 along a mating direction of the electrical connector 100 and the plug 200.

Figure 6:
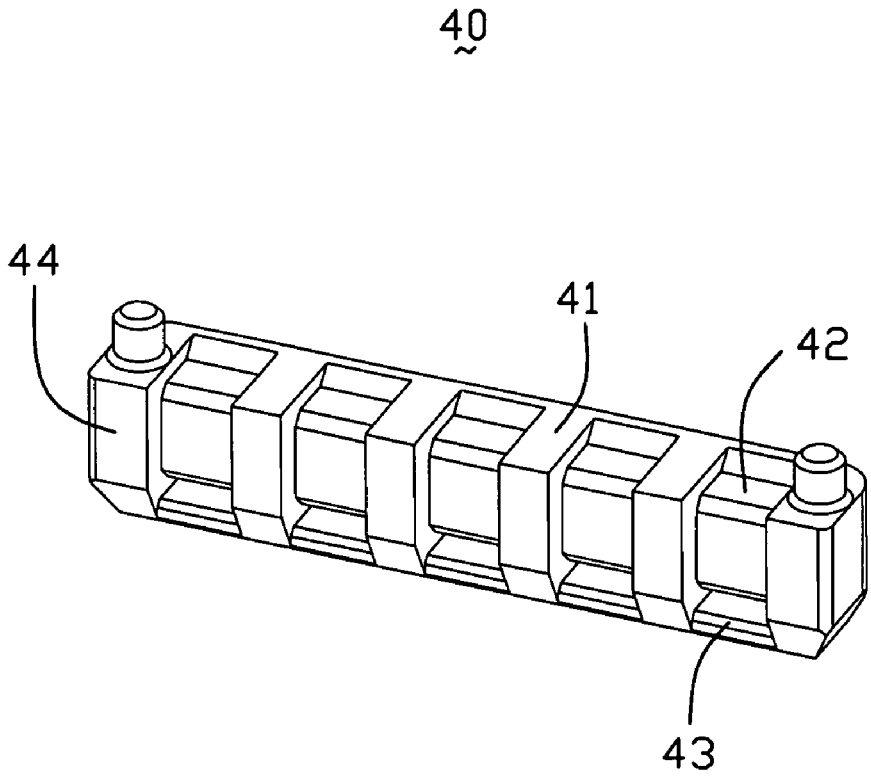
FIG. 6 is a perspective view of the insulative nose shown in FIG. 3.
Figure 7:
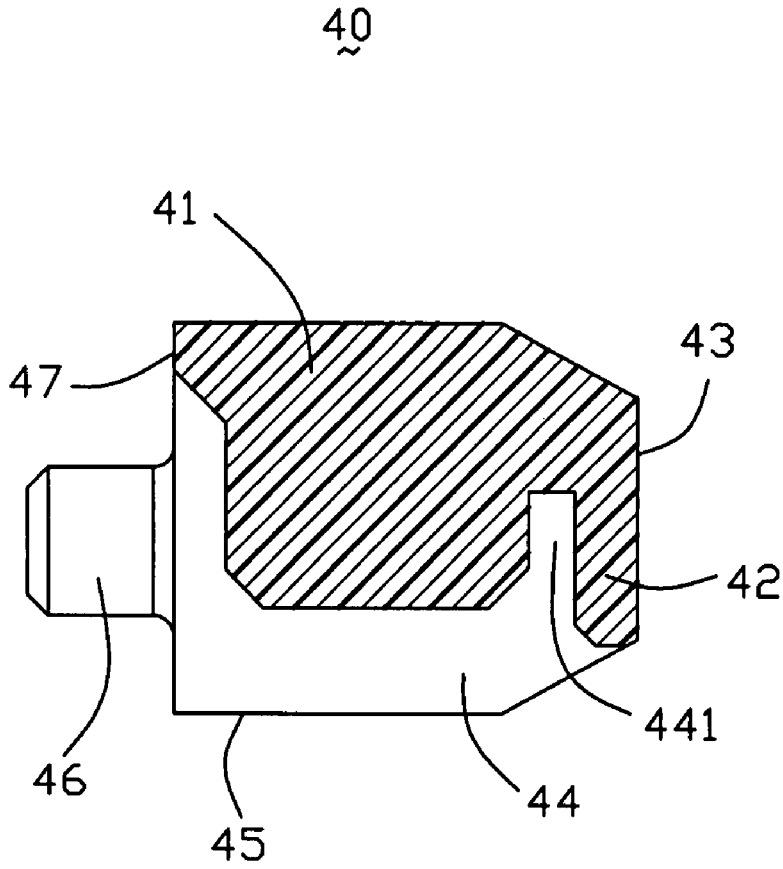
FIG. 7 is a cross sectional view of the insulative nose shown in FIG. 3.
Figure 8:
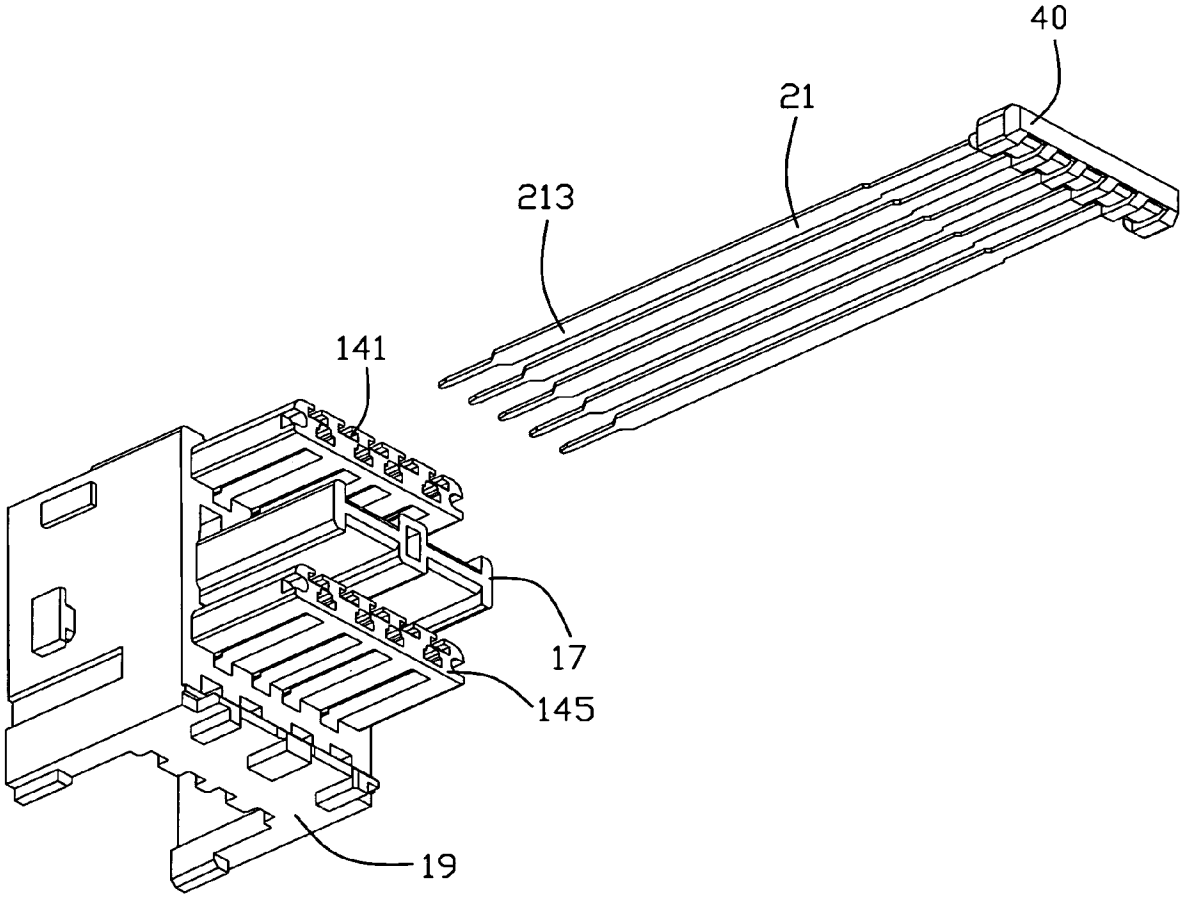
FIG. 8 is a partial view of the electrical connector, showing the relationship of the set of upper contacts and the insulative nose before assembling to the insulative housing.

As illustrated in FIGS. 6 to 8, the insulative housing 10 further comprises two insulative noses 40 at a front end thereof adapted to attach to the tongue 14, 15. The insulative nose 40 comprises a body 41 and a front wall 42 provided with a mating face 43 facing to the plug 200. The body 41 and the front wall 42 define an opening 44 open to a bottom face 45 of the insulative nose 40 for receiving a front end of the electrical contacts 20 therein. The opening 44 includes a slit 441 being covered by the front wall 42 at the mating face 43. Pair of posts 46 project from a rear face 47 of the body 41 at two opposite sides of the insulative nose 40 for aligning the insulative nose 40 with the tongue 14, 15 and interference with the receiving holes 146 of the tongue 14, 15.

Figure 9:
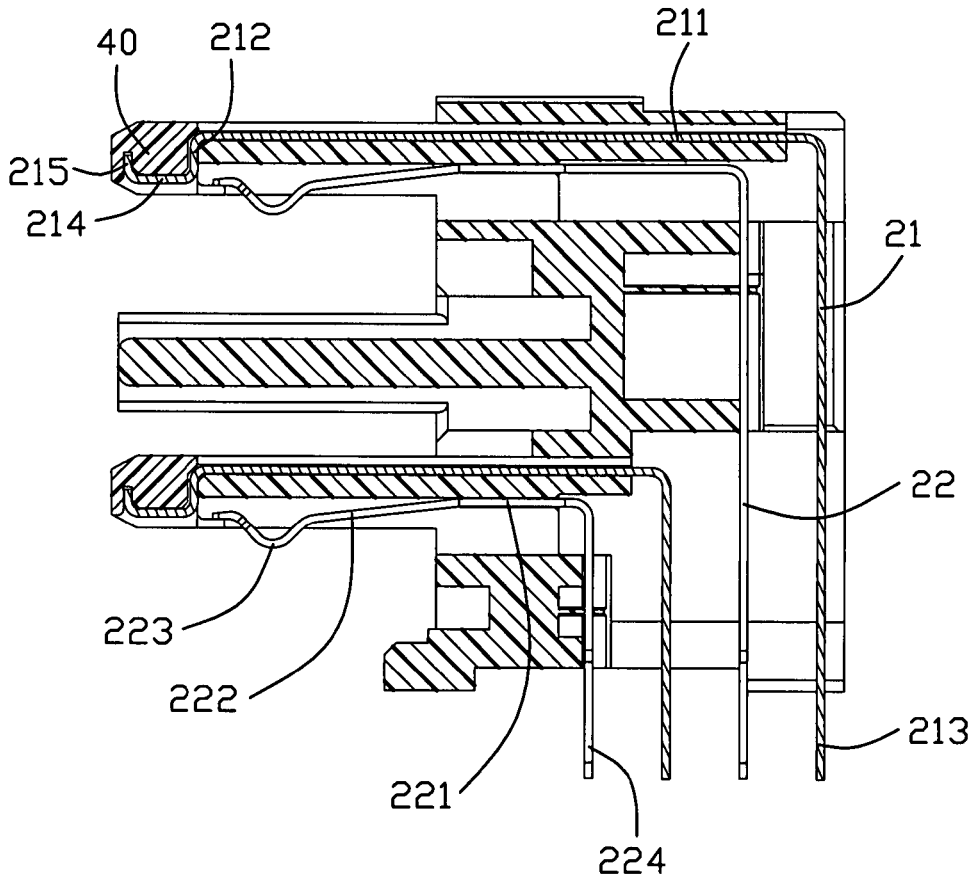
FIG. 9 is a cross sectional view of the insulative housing and the electrical contacts shown in FIG. 3.
Figure 10:
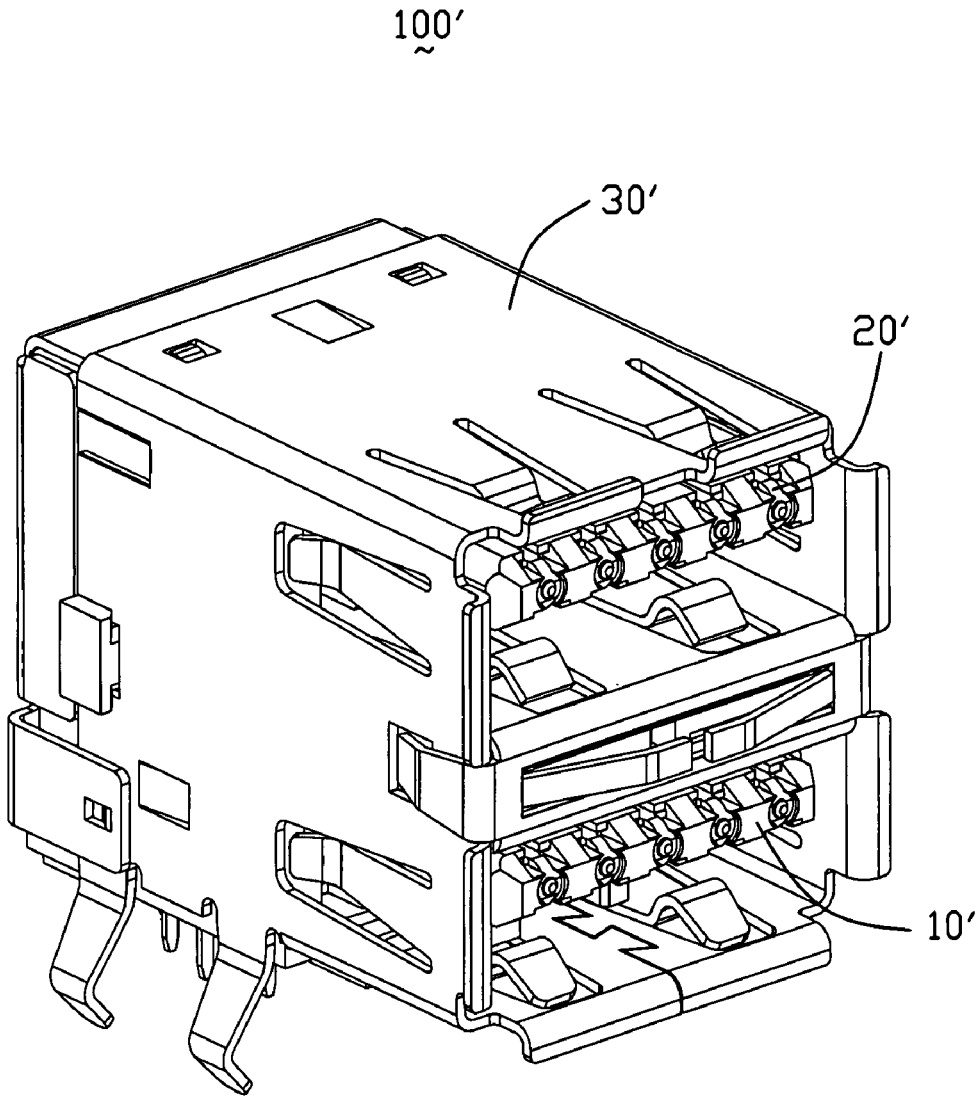
FIG. 10 is a perspective view of an electrical connector according to a second embodiment of the present invention.
Figure 11:
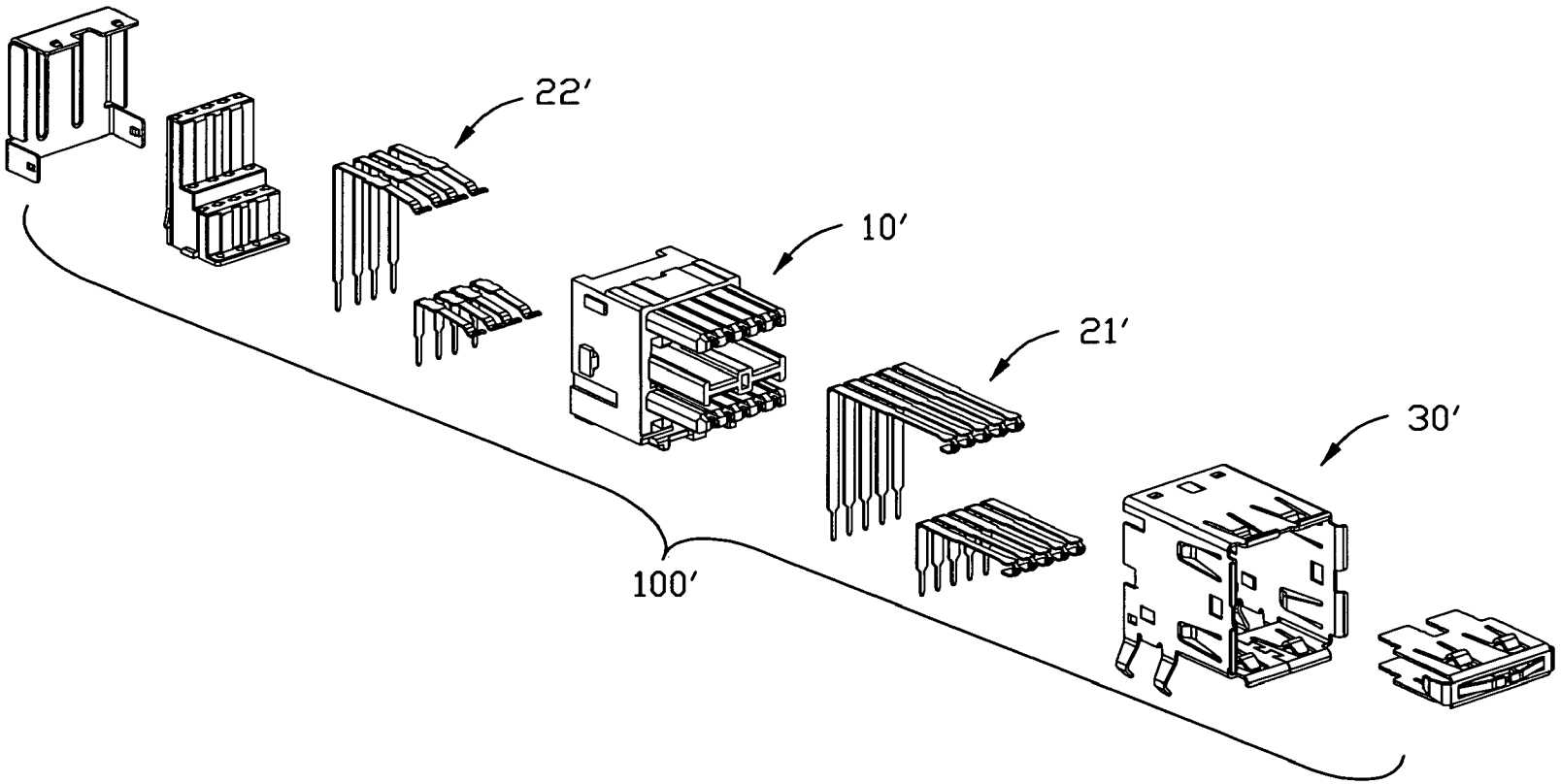
FIG. 11 is an exploded view of the electrical connector shown in FIG. 10.
Figure 12:
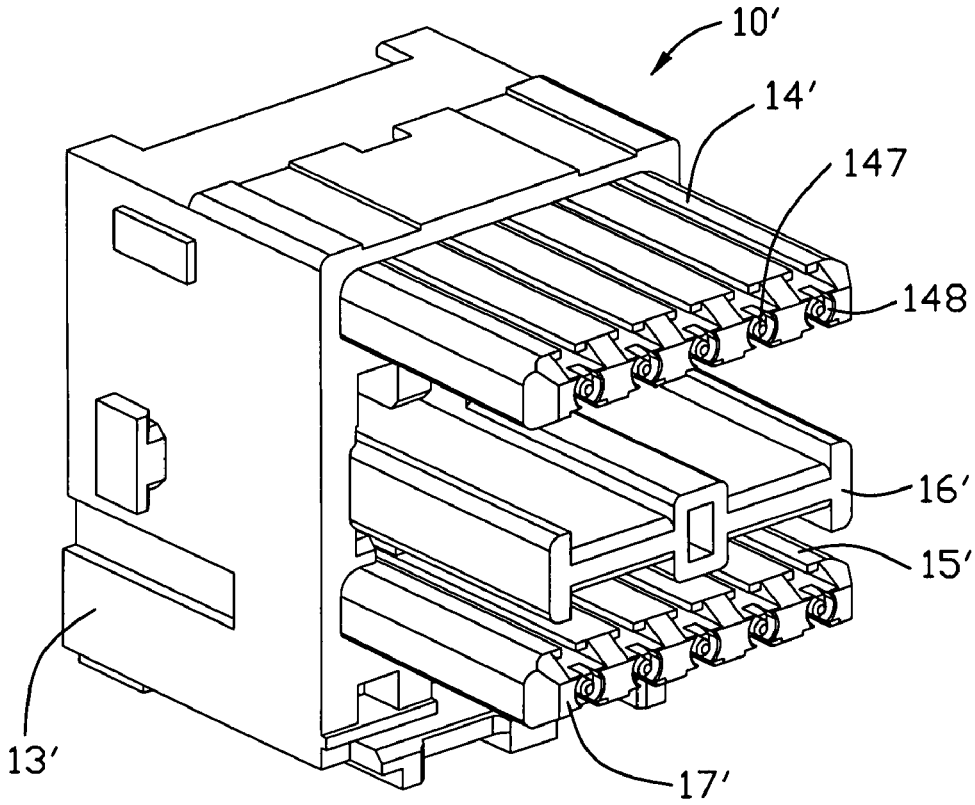
FIG. 12 is a perspective view of the insulative housing shown in FIG. 1.
Figure 13:
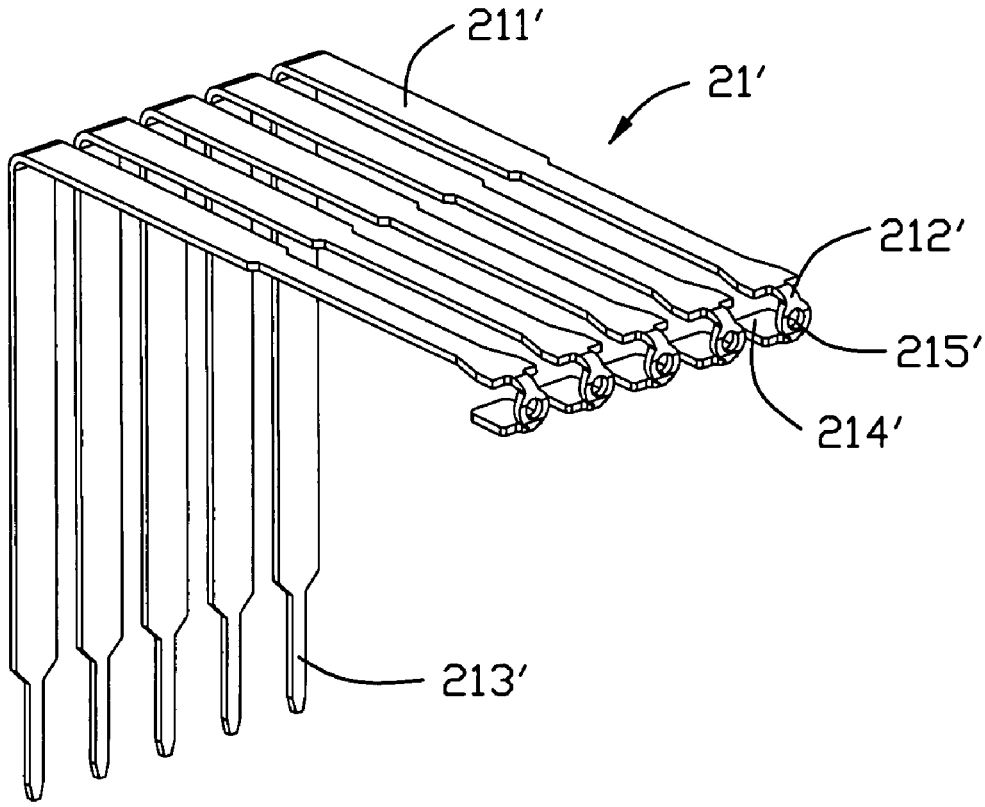
FIG. 13 is a perspective view of the set of upper electrical contacts shown in FIG. 11.
Figure 14:
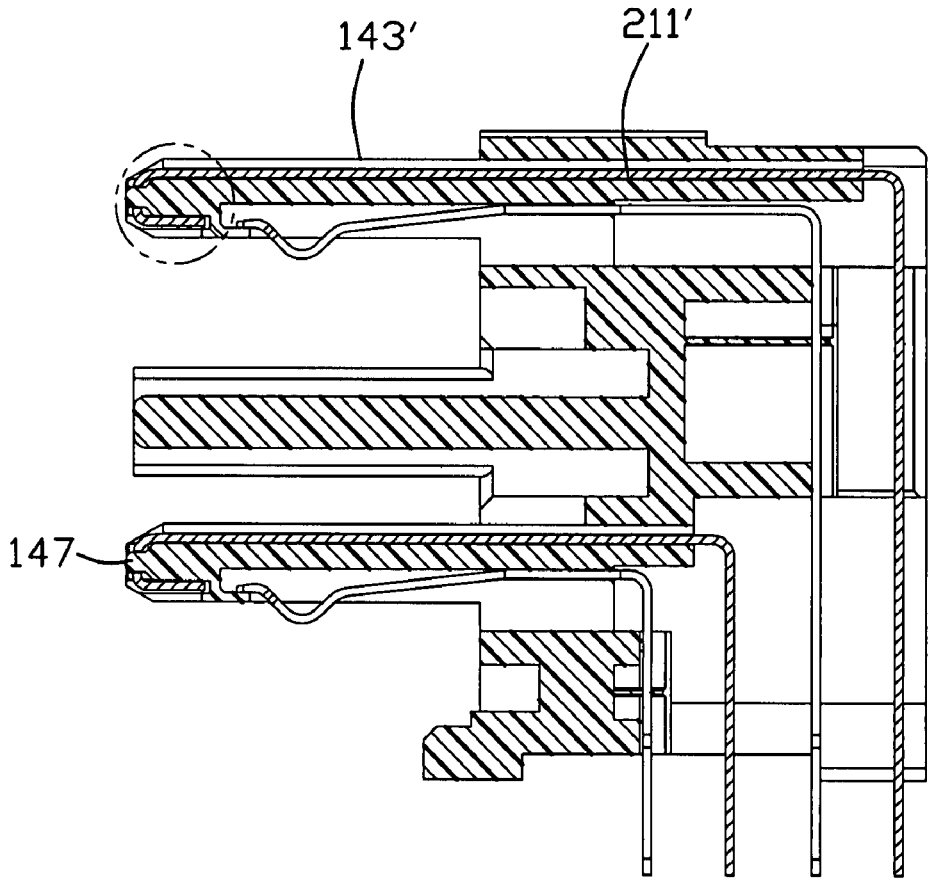
FIG. 14 is a cross sectional view of the insulative housing and the electrical contacts shown in FIG. 11.
Figure 15:
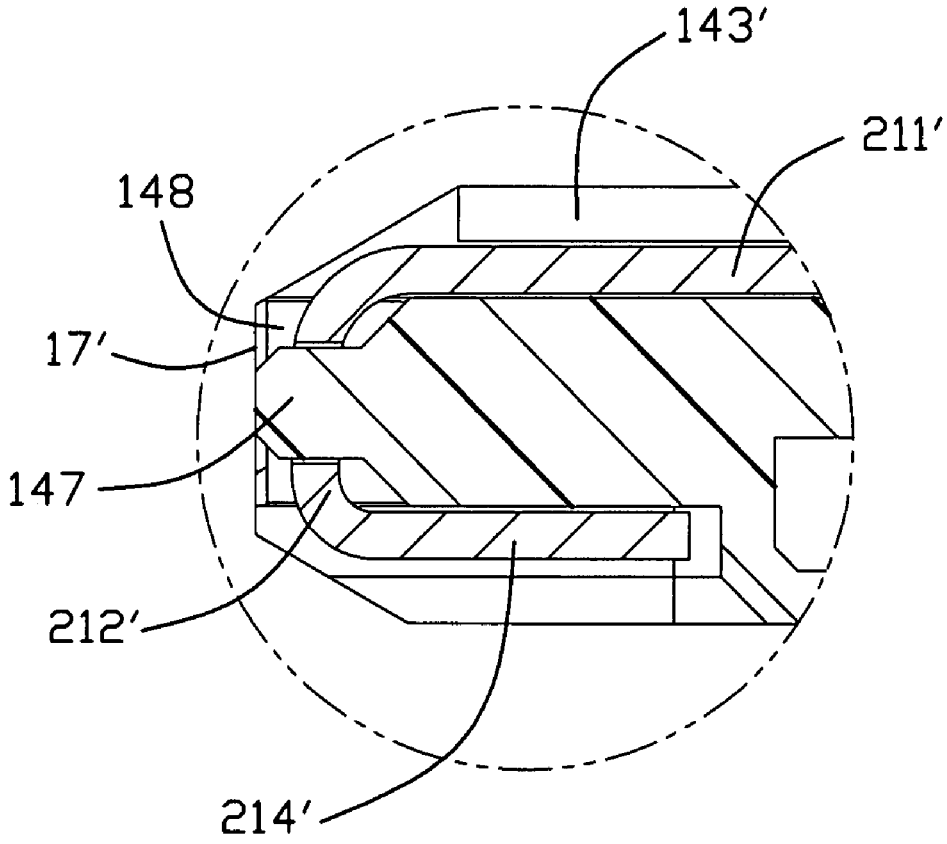
FIG. 15 is an enlarge view of a circle part shown in FIG. 14.

Referring to FIG. 9, each group of electrical contacts 20 includes a set of upper contacts 21 and a set of lower contacts 22. Each lower contact 22 includes a retention section 221 engaging with the insulative housing 10. An elastic contact section 222 extends from one end of the retention section 221 along the mating direction and has a convex bend 223 mating with the plug contact (not shown) of the mating plug 200. The contacts sections 222 are arranged in the lower recesses 142 of the tongue 14, 15. The lower contacts 22 also include a mounting section 224 extending from the other end of the retention section 221 for mounting to the PCB.

Each upper contacts 21 also includes a retention section 211 engaging with the insulative housing 10 at the upper side 143 of the tongue 14, 15, a connect section 212 bending from one end of the retention section 211, and a mounting section 213 extending from the other end of the retention section 211. The retention section 211 is parallel to the tongue 14, and received in the upper recess 141. The connect section 212 is extending from a front edge of the retention section 211 to the lower side 144 of the tongue 14, 15. A flat non-elastic contact section 214 is extending forwardly from the connect section 212 and parallel to the retention section 211. The contact section 214 is provided a front tip section 215 at a front edge thereof and bending upwardly therefrom.

Figure 2:
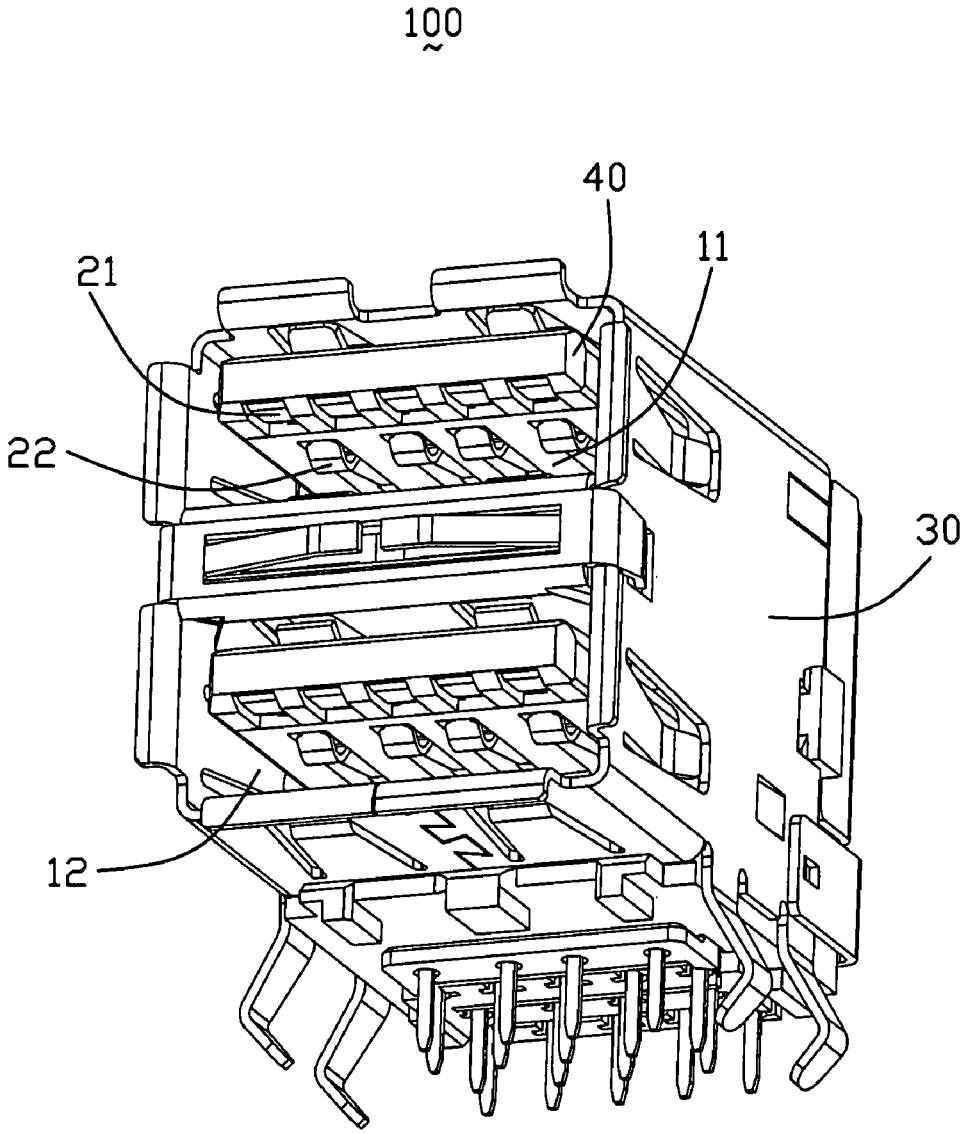
FIG. 2 is another perspective view of the electrical connector shown in FIG. 1, while taken from a different aspect.

As illustrated in FIGS. 2 and 9, the contact portions 214, 222 of the upper contacts 21 and the lower contacts 22 are located on the lower side of the tongue 14, 15 and staggered along the mating direction of the electrical connector 100. The contact portions 214 of the upper contacts 21 are closer to the mating face 43 than the contact sections 222 of the lower contacts 22. The contact points, namely the contact sections 214 and the convex bends 223 of the upper contacts 21 and the lower contacts 22 also staggered along a vertical direction thereby to mating with the contacts 80 of the plug 200 at different height.

The opening 44 of the insulative nose 40 receives the connect sections 212, the contact sections 214, and the tip sections 215 of the upper contacts 22 therein. The contact sections 214 are exposed to the bottom face 45 of the insulative nose 40. The tip sections 215 are disposed in the interior slit 441 and covered by the front wall 42 at the front face 43 of the insulative nose 40. The front wall 42 is located between the tip sections 215 of the upper contacts 21 and the mating face 43 to avoid the upper contacts 21 contacting with the shell 80 of the plug 200.

As illustrated in FIGS. 8 and 9, during assembly, the front ends of the upper contacts 21 are fitted to the insulative nose 40 firstly. The upper contacts 21 and the insulative nose 40 constitute an assembly to attach to the tongue 14, 15 and the body portion 13. The upper contacts 21 insert into the upper recesses 141 and the insulative nose 40 snaps the tongue 14, 15. Afterwards, bend the upper contacts 21 thereby the mounting sections 213 thereof extending out of a mounting face 19 of the insulative housing 10. The upper contacts 21 and the lower contacts 22 are inserted into the insulative housing 10 from the opposite front and rear face 17, 18 thereof respectively. A spacer 50 is attached to the base portion 13 for positioning the upper and lower contacts 21, 22 at the mounting face 19.

Next referring to FIGS. 10 to 14, description will be made of a connector 100' according to a second embodiment of the present invention. The connector 100' comprises a plurality of electrical contacts 20', an insulative housing 10' holding the electrical contacts 20' thereon, and a shield 30' surrounding all of the above mentioned components. The insulative housing 10' comprises a base portion 13' and two tongues 14', 15' extending forwardly from the base portion 13'. The electrical contact also includes a set of upper contacts 21' and a set of lower contacts 22'.

The electrical connector 100' is substantially similar to the electrical connector 100 except the tongue 14', 15' and the upper contacts 21'. The tongue 14', 15' is longer than a middle flange 16' of the insulative housing 10'. A plurality of recesses 147 are defined at a front end of the tongue portion 14', 15' and open to a front mating face 17' of the insulative housing 10'. The tongue 14', 15' comprises a plurality of posts 148 disposed in front of the upper contacts 21' and projecting into the recesses posts 147.

The upper contact 21' includes a retention section 211' engaging with the insulative housing 10' at a upper side 143' of the tongue 14', 15', a connect section 212' bending from a front edge of the retention section 211', and a mounting section 213' bending from a rear edge of the retention section 211'. A flat non-elastic contact section 214' is extending backwardly from the connect section 212' and parallel to the retention section 211'. The retention section 211' and the contact section 214' are overlapped in the mating direction of the electrical connector 100'. The connect section 212' defines an aperture 215' for the post 148 extending therethrough.

The connect sections 212' are separated from the mating face 17' with a small clearance therebetween to prevent the upper contacts 21' directly exposing to the mating face 17'. During the preliminary insertion of the plug 200, since the posts 148 are located in front of the connector sections 212' which can block the shell 80 of the plug 200 contacting with the upper contacts 21', thereby avoiding an improper electrical connection between the upper contacts 21' and the plug 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector for engaging with a mating plug having a metal shell, comprising:

an insulative housing comprising a base portion and a tongue portion extending forwardly from the base portion;

a set of first electrical contacts arranged in the isulative housing, each first contacts comprising a contact section engaging with the plug at a front position of the tongue;

a set of second electrical contacts arranged in the insulative housing and each comprising a contact section engaging with the plug at a rear position of the tongue; and an insulator located in front of the first electrical contacts to prevent the first electrical contacts contacting with the shell of the plug.

2. The electrical connector according to claim 1, wherein the contact sections of the first electrical contacts and the second electrical contacts are arranged at different height.

3. The electrical connector according to claim 1, wherein the contact sections of the second electrical contacts are elastic and the contact sections of the first electrical contacts are non-elastic.

4. The electrical connector according to claim 1, wherein the insulator is integrally formed on the tongue portion.

5. The electrical connector according to claim 4, wherein each first contacts further comprises a retention section engaging with the insulative housing and parallel to the contact section, and wherein the retention section and the contact section are overlapped in a mating direction of the electrical connector, a tip section connecting with the contact section and the retention section.

6. The electrical connector according to claim 5, wherein the tongue portion defines a plurality of recesses at a front end thereof and opening to the mating face, and wherein the insulator comprises a plurality of posts located in the recesses and extending through a plurality of through holes defined on the tip sections of the first contacts.

7. The electrical connector according to claim 1, wherein the insulator is attached to the tongue portion of the insulative housing, and wherein the insulator comprises a body provided with a cavity and a front wall covering the cavities.

8. The electrical connector according to claim 7, wherein each first electrical contacts further comprises a retention section engaging with the insulative housing, a connect section located between the contact section and the retention section, and a tip section bending from a front edge of the contact section.

9. The electrical connector according to claim 8, wherein the contact section is paralleled to the retention section and extending from the connect section to the mating face.

10. The electrical connector according to claim 9, wherein the connect sections, the contact sections and the tip sections of the first contacts are received in the cavity of the insulator, and wherein the insulator covered the tip sections.

11. An electrical connector for receiving a plug therein comprising:

an insulative housing comprising a base portion and a tongue portion extending forwardly from the base portion;

a first set of electrical contacts each comprising a retention section on the base portion and a front end extending forwardly from the retention section;

a second set of electrical contacts each comprising a retention section on the base portion and a front end extending forwardly from the retention section and being arranged on the tongue portion; and an insulative nose attached to a front end of the tongue portion, the front ends of the first set of electrical contacts being arranged on the insulative nose, and wherein the insulative nose covers the front ends of the first set of electrical contacts at a mating face thereof to avoid an improper connection between the first contacts and the plug.

12. The electrical connector according to claim 11, wherein the first set of electrical contacts and the second set of electrical contacts are attached to the insulative housing from opposite sides thereof respectively.

13. The electrical connector according to claim 11, wherein the insulative nose comprises a cavity for receiving the front ends of the first set of electrical contacts therein and a front wall in front of the cavity to cover the first set of electrical contacts, the insulative nose further comprising a pair of posts for interference with the tongue portion.

14. The electrical connector according to claim 11, wherein the front end of the first set of electrical contact comprise a contact section mating with the plug and a tip section, and wherein the contact sections of the first set of electrical contacts are staggered with the retention sections thereof along an insert direction of the plug.

15. The electrical connector according to claim 11, wherein the first set of electrical contacts and the second set of electrical contacts contact with the plug at different height.

16. An electrical connector comprising:

an insulative housing defining a mating tongue having thereon first and second faces opposite to each other wherein said first face is a mating face;

a set of first contacts having a rear first mounting portion behind the mating tongue and a front first mating portion extending essentially along the first face with a first mating region around a rear region of the first face;

a set of second contacts having a rear second mounting portion behind the mating tongue and a front second mating portion extending essentially along the second face with a second mating region bent backward to be located in a front region of the first face; wherein a front edge of the mating tongue defines a plurality of channels respectively receiving a bent section of the corresponding second mating portion so that said bent section is protectively located behind said front edge.

17. The electrical connector as claimed in claim 16, wherein one of said bent section and said mating tongue defines a protrusion, and the other defines a through hole receiving said protrusion in a mating direction.

* * * * *